US012594591B2

(12) United States Patent
Stammen et al.

(10) Patent No.: US 12,594,591 B2
(45) Date of Patent: Apr. 7, 2026

(54) PRESS SYSTEM AND SHELL FEEDING ASSEMBLY THEREFOR

(71) Applicant: Stolle Machinery Company, LLC, Centennial, CO (US)

(72) Inventors: Dennis Cornelius Stammen, Brookville, OH (US); Steven Todd Albright, Piquo, OH (US); Bryan Lee Schoenlein, Minster, OH (US); Neil Albert Zumberger, Sidney, OH (US); Edward Eugene Donaldson, North Canton, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 342 days.

(21) Appl. No.: 18/122,799

(22) Filed: Mar. 17, 2023

(65) Prior Publication Data

US 2024/0307946 A1 Sep. 19, 2024

(51) Int. Cl.
*B21D 43/09* (2006.01)

(52) U.S. Cl.
CPC ..... *B21D 43/09* (2013.01)

(58) Field of Classification Search
CPC ..... B21D 43/02; B21D 43/08; B21D 43/09; B21D 51/446; B21C 47/18
See application file for complete search history.

(56) References Cited

U.S. PATENT DOCUMENTS

| | | | | |
|---|---|---|---|---|
| 3,580,021 A * | 5/1971 | Cramer | B21C 47/34 72/183 |
| 3,647,127 A * | 3/1972 | Wiig | B65H 20/04 226/177 |
| 3,786,549 A | 1/1974 | Pott | |
| 4,138,913 A * | 2/1979 | Gentile | B21D 43/08 83/202 |
| 5,150,022 A * | 9/1992 | Waddington | B21D 43/09 318/563 |
| 5,381,887 A * | 1/1995 | Emmons | B65G 39/02 198/830 |

(Continued)

FOREIGN PATENT DOCUMENTS

| | | |
|---|---|---|
| CN | 110605339 A | 12/2019 |
| CN | 111167961 A | 5/2020 |
| CN | 114011986 | 2/2022 |

OTHER PUBLICATIONS

WO 2009/097402A1, Martin et al. Aug. 2009.*

(Continued)

*Primary Examiner* — Edward T Tolan
(74) *Attorney, Agent, or Firm* — Eckert Seamans Cherin & Mellott, LLC

(57) ABSTRACT

A feeding assembly is for feeding material to a press system. The press system includes a shell press having a die set structured to form the material into a plurality of shells. The feeding assembly includes a support element, a feed roll including an integral shaft, a drive assembly driving the feed roll and including a motor and a drive shaft, the drive shaft, and a pinch roll cooperating with the feed roll to receive and move material therebetween. The longitudinal axis of the integral feed roll shaft is laterally offset with respect to the longitudinal axis of the motor drive shaft.

16 Claims, 9 Drawing Sheets

(56) References Cited

U.S. PATENT DOCUMENTS

| | | | | |
|---|---|---|---|---|
| 5,755,370 | A * | 5/1998 | Gentile | B21D 43/09 100/168 |
| 5,868,296 | A | 2/1999 | Gentile et al. | |
| 9,073,721 | B2 | 7/2015 | Stodd | |
| 9,637,339 | B2 | 5/2017 | Stodd et al. | |
| 2002/0023474 | A1* | 2/2002 | McClung | B21D 22/24 72/348 |
| 2003/0200877 | A1* | 10/2003 | Blei | B21D 43/09 100/214 |
| 2012/0067102 | A1* | 3/2012 | Stodd | B21D 51/44 72/351 |

OTHER PUBLICATIONS

KR 20210000853U, Korean Apr. 2021.*
CN 114011986A, Zheng et al. Feb. 2022.*
CN 110405098B, Wang et al. Aug. 2021.*
CN 105689583A, Bao Jun. 2016.*
JP 59-39430A, Itabashi Mar. 1984.*
Translation JP 59-39430A, Itabashi Mar. 1984.*
KR 20130122307A, Sin Nov. 2013.*
International Searching Authority/U.S. Patent and Trademark Office, PCT/US24/12914 International Search Report and Written Opinion, Apr. 11, 2024, 10 pages.

* cited by examiner

PRESS SYSTEM AND SHELL FEEDING ASSEMBLY THEREFOR

FIELD OF THE INVENTION

The disclosed concept relates generally to press systems and, more particularly, to shell presses and associated methods for forming container closures or ends, commonly referred to as shells. The disclosed concept also relates to feeding assemblies for shell presses.

BACKGROUND OF THE INVENTION

The formation of can ends or shells for can bodies, namely aluminum or steel cans, is generally well known in the art.

FIG. 1 shows an example press system 2 comprising a shell press 4 designed to form shells 6 (shown in simplified form) from a sheet of material 50 (e.g., without limitation, aluminum) as it is fed between a die set 10 (indicated generally and not shown in detail in FIG. 1). More specifically, the material 50 is supplied as coil stock 52 (shown in simplified form). A feeding assembly 20 having a plurality of rolls 22, 24 forms a stock loop 26 to facilitate delivery of the material 50 to and between the die set 10 of the shell press 4. The feeding assembly 20 is spaced apart from the shell press 4 a distance, d. This distance, d, measured between the centerline 14 of the shell press 4 and the centerline 28 of the feeding assembly 20, corresponds to the indexing stock of material 50. Supporting elements 30 are included to support the indexing stock of material 50 between the feeding assembly 20 and the shell press, and conveyance equipment 40 is provided for conveying the shells 6 from the shell press 4 after being formed by the die set 10.

There is an ongoing desire in the canmaking industry to manufacture high volumes of shells as rapidly and efficiently as possible. Among other ways companies have attempted to achieve these objectives are: (1) to increase the number of pockets in the die set, within which shells can be formed; and (2) to increase the speed (e.g., strokes per minute (spm)) at which the shell press operates. In general, with each stroke of the shell press ram, one shell is formed in each tooling pocket of the die assembly. Thus, a 24-out die assembly, for example, which has 24 tooling pockets, is capable of forming 24 shells, per stroke.

As the size of the die sets increase, the correspondence size (e.g., width) of the coil stock also increases. Feeding such material at relatively high speeds creates a number of unique design challenges.

There is, therefore, room for improvement in shell presses, and in feeding assemblies therefor.

SUMMARY OF THE INVENTION

These needs, and others, are met by embodiments of the disclosed concept, which are directed to an improved feeding assembly and shell press.

As one aspect of the disclosed concept a feeding assembly is provided for feeding material to a press system. The press system includes a shell press having a die set structured to form the material into a plurality of shells. The feeding assembly comprises: a support element; a feed roll coupled to the support element and including an integral shaft having a longitudinal axis; a drive assembly structured to drive the feed roll, the drive assembly including a motor and a drive shaft, the drive shaft having a longitudinal axis; and a pinch roll structured to cooperate with the feed roll to receive and move said material therebetween. The longitudinal axis of the integral feed roll shaft is laterally offset with respect to the longitudinal axis of the motor drive shaft.

The motor may be a servo motor, and the drive assembly may further include a pulley assembly and a drive belt. The pulley assembly may include a drive member coupled to the motor drive shaft and a pulley coupled to the integral shaft of the feed roll, wherein the drive belt operatively couples the drive member and the pulley and is structured to resist backlash.

The die set of the shell press may have a centerline and the feeding assembly may have a centerline, wherein the distance, D, between the centerline of the die set and the centerline of the feeding assembly is the indexing stock, and wherein the indexing stock is 70 inches or less.

The longitudinal axis of the integral feed roll shaft may be disposed 40 inches or less from the centerline of the die set. The shell press may have a base, wherein the support element of said feeding assembly is structured to overlap at least a portion of said base.

The feed roll may comprise an outer cylinder, a concentric inner cylinder, and a plurality of webs extending between and connecting the outer cylinder and the inner cylinder to create a lightweight substantially hollow structure. The integral shaft of the feed roll may be a steel shaft extending through the inner cylinder.

The pinch roll may include a core, an outer cover overlaying the core, a pair of bearings disposed at opposite ends within the core, and a shaft extending through the core between the bearings. The core may be made from steel, and the outer cover may be made from polyurethane or other metallic material.

A press system including the aforementioned feeding assembly is also disclosed. The die set of the of the shell press may be disposed in a horizontal plane, and the shell press may have load conveyance equipment and exit conveyance equipment, wherein the load conveyance equipment is disposed at an angle with respect to the horizontal plane of the die set.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
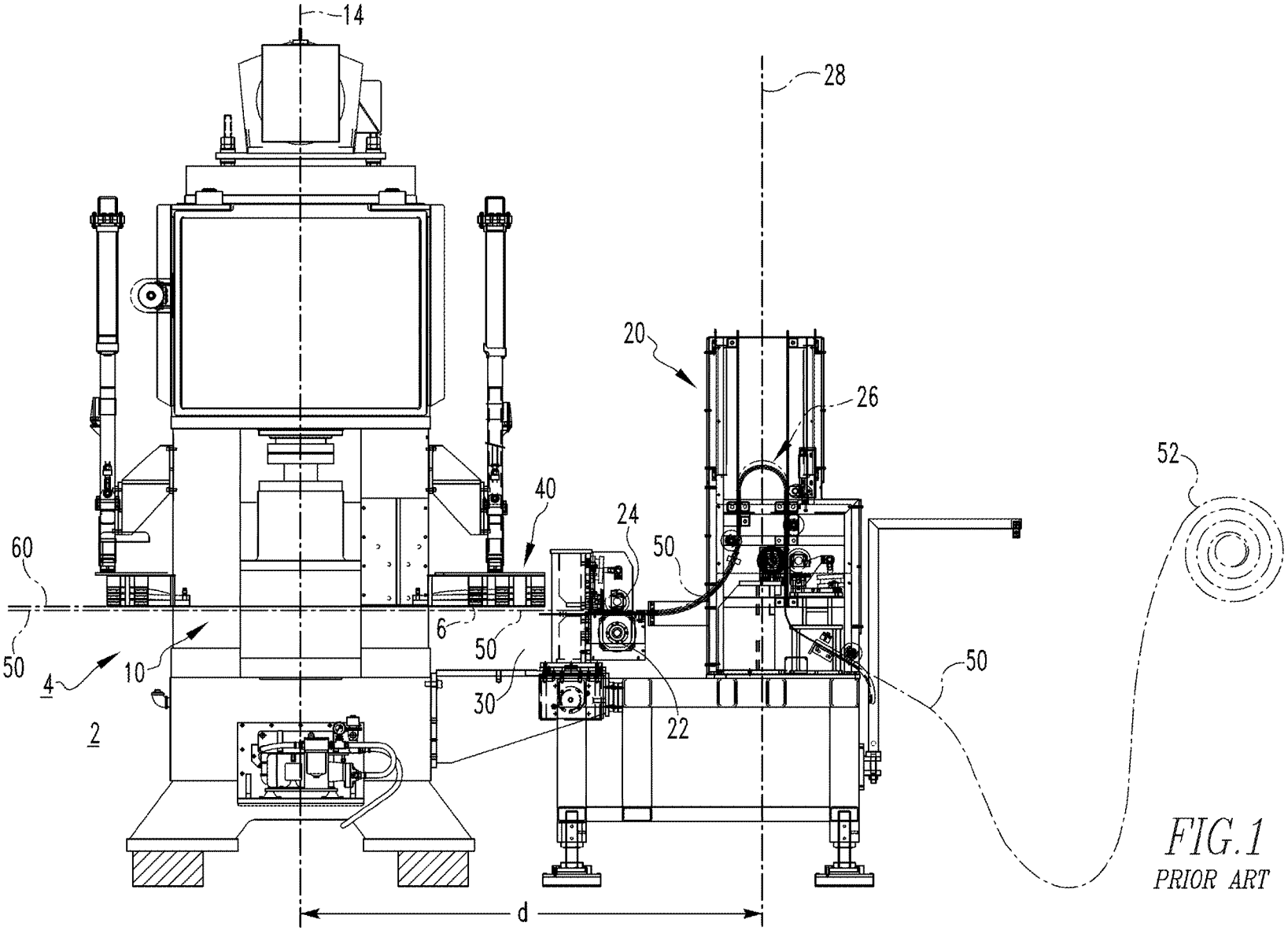
FIG. 1 PRIOR ART
FIG. 1 is an elevation view of a prior art shell press.

For purposes of illustration, embodiments of the disclosed concept will be described as applied to a wide out shell press, although it will become apparent that they could also be applied to a variety of alternative press systems having any known or suitable size and/or configuration of metal forming tooling and related components.

Directional phrases used herein such as, for example, clockwise, counterclockwise, upper, lower, top, bottom, and derivatives thereof, relate to the orientation of the elements shown in the drawings and are not limiting upon the claims unless expressly recited therein.

As employed herein, the term "can" refers to any known or suitable container, which is structured to contain a substance (e.g., without limitation, liquid; food; any other suitable substance), and expressly includes, but is not limited to, beverage cans, such as aluminum beer and soda cans, as well as food cans.

As employed herein, the term "can end" refers to the closure that is structured to be coupled to the can, in order to seal the can.

As employed herein, the terms "shell" and "can end shell" refer to the member that is formed in the disclosed shell press and is subsequently acted upon and converted by suitable tooling, typically within a conversion press, in order to provide the desired can end.

Figure 2:
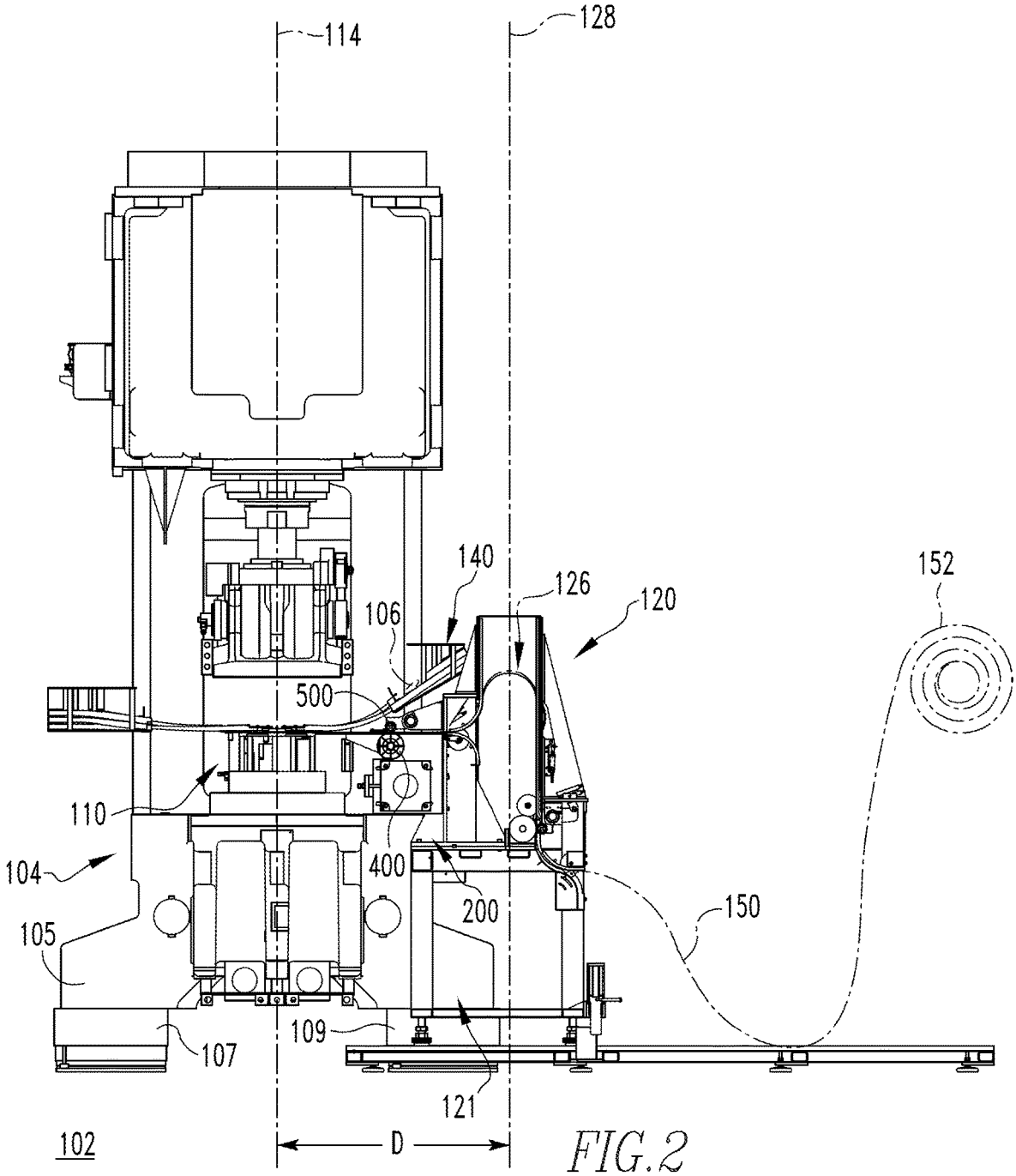
FIG. 2 is an elevation view of a shell press and feeding assembly therefor, in accordance with an embodiment of the disclosed concept.
Figure 3:
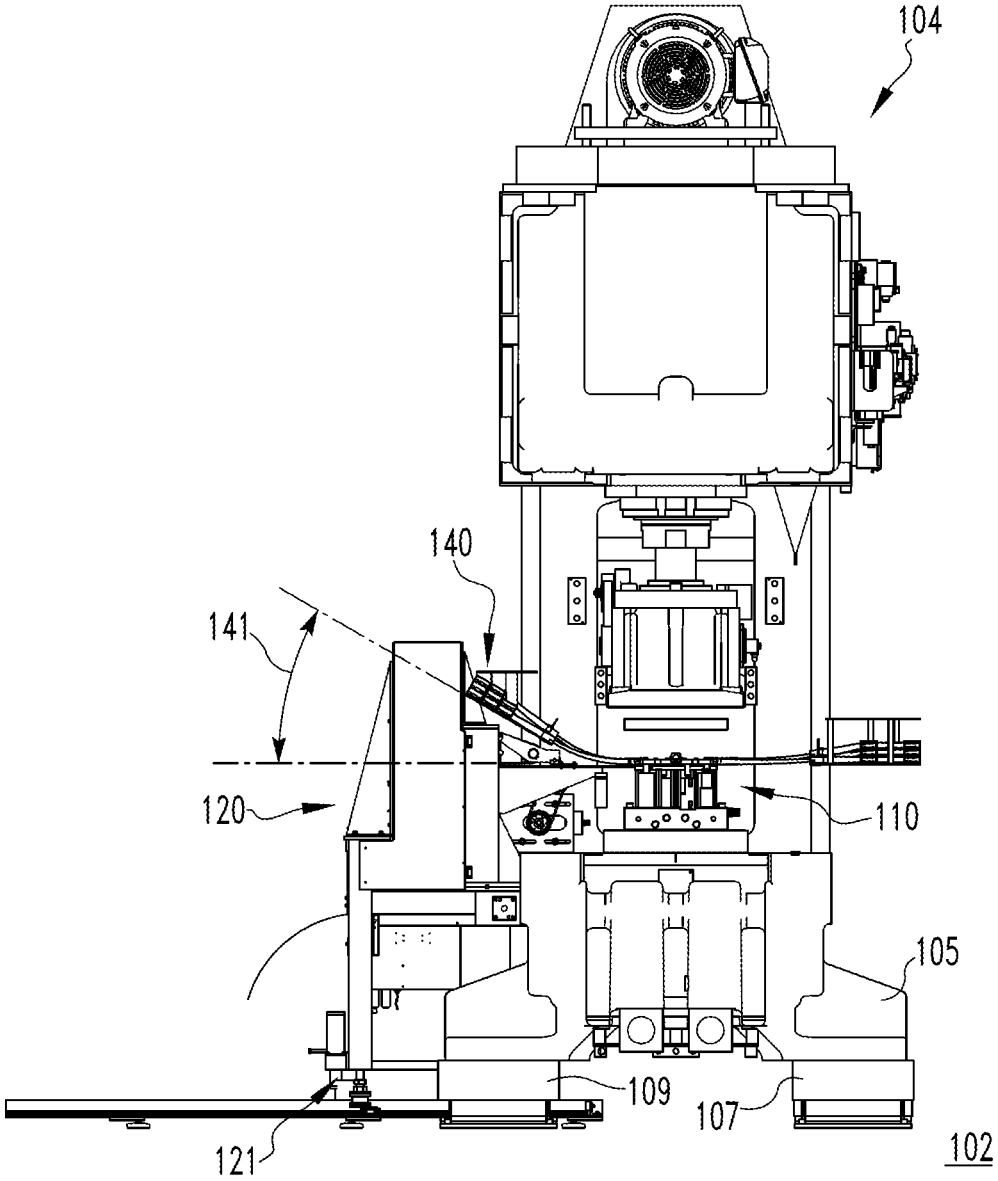
FIG. 3 is another elevation view of the shell press of FIG. 2, showing additional aspects of the disclosed concept.

FIGS. 2 and 3 show a feeding assembly 120 for feeding material 150 to a press system 102 according to non-limiting aspects of the disclosed concept. The press system 102 includes a shell press 104 having a die set 110 (indicated generally and not shown in specific detail in FIG. 2) structured to form the material 150 into a plurality of shells (shown in simplified form in FIG. 2). It will be appreciated that the material 150 (e.g., without limitation, sheet aluminum) and associated coil stock 152 are shown in simplified form herein for convenience of reference and ease of illustration.

The disclosed feeding assembly 120 includes a number of new and unique features that will be described in detail hereinbelow, and which significantly enhance the manufacturing performance of the press system 102. By way of one non-limiting example, in accordance with a preferred embodiment of the disclosed concept, the feeding assembly 120 uses an index and dwell feeding cycle to enable high-speed (e.g., without limitation, preferably greater than 450 strokes per minute (spm) and, more preferably, greater up to 700 spm) feeding of wide (e.g., without limitation, up to 50 inches, or wider) aluminum coil stock (e.g., coil stock 152 shown in simplified form in FIGS. 2 and 3).

Figure 4:
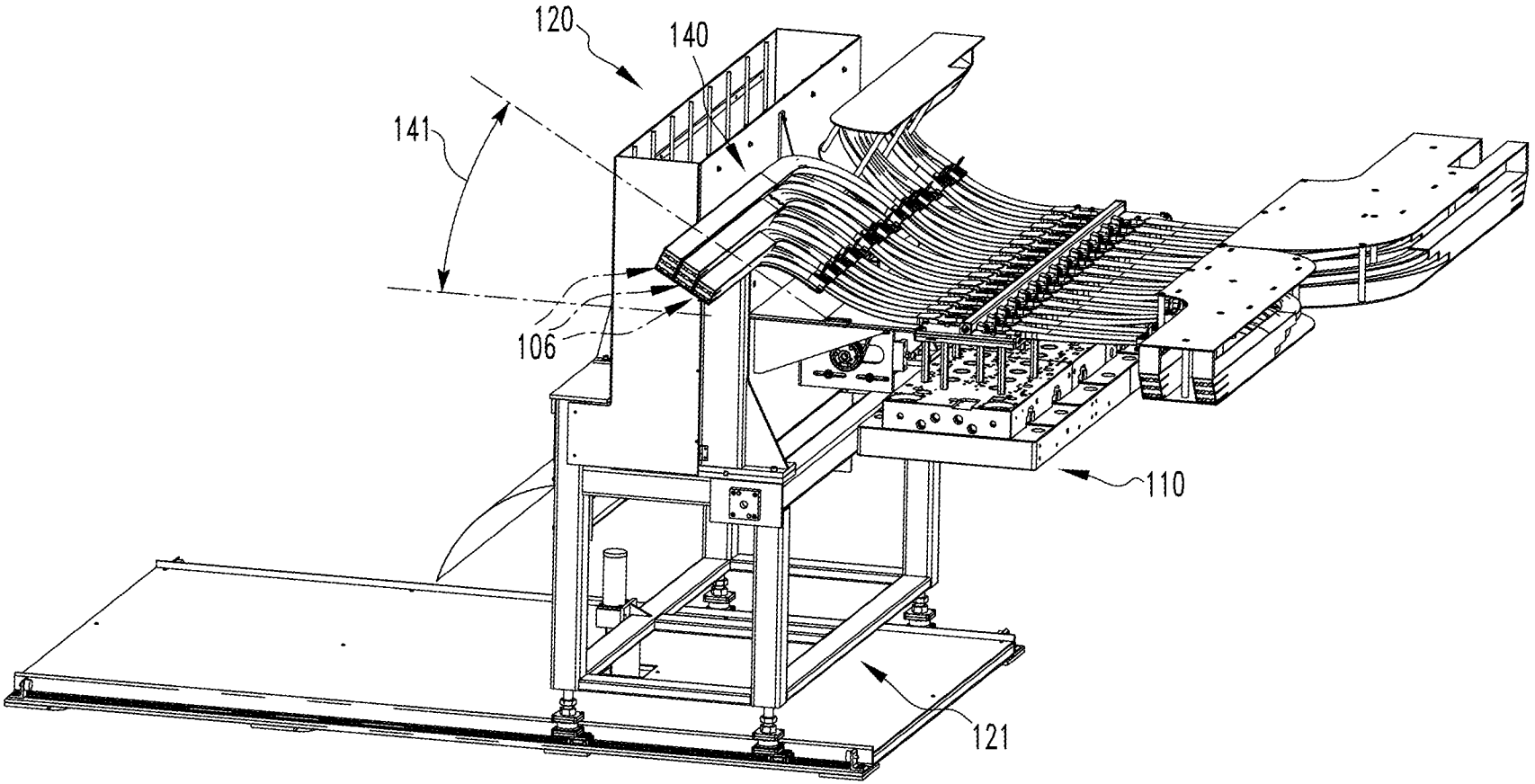
FIG. 4 is an isometric view of the shell press of FIG. 3.
Figure 5A:
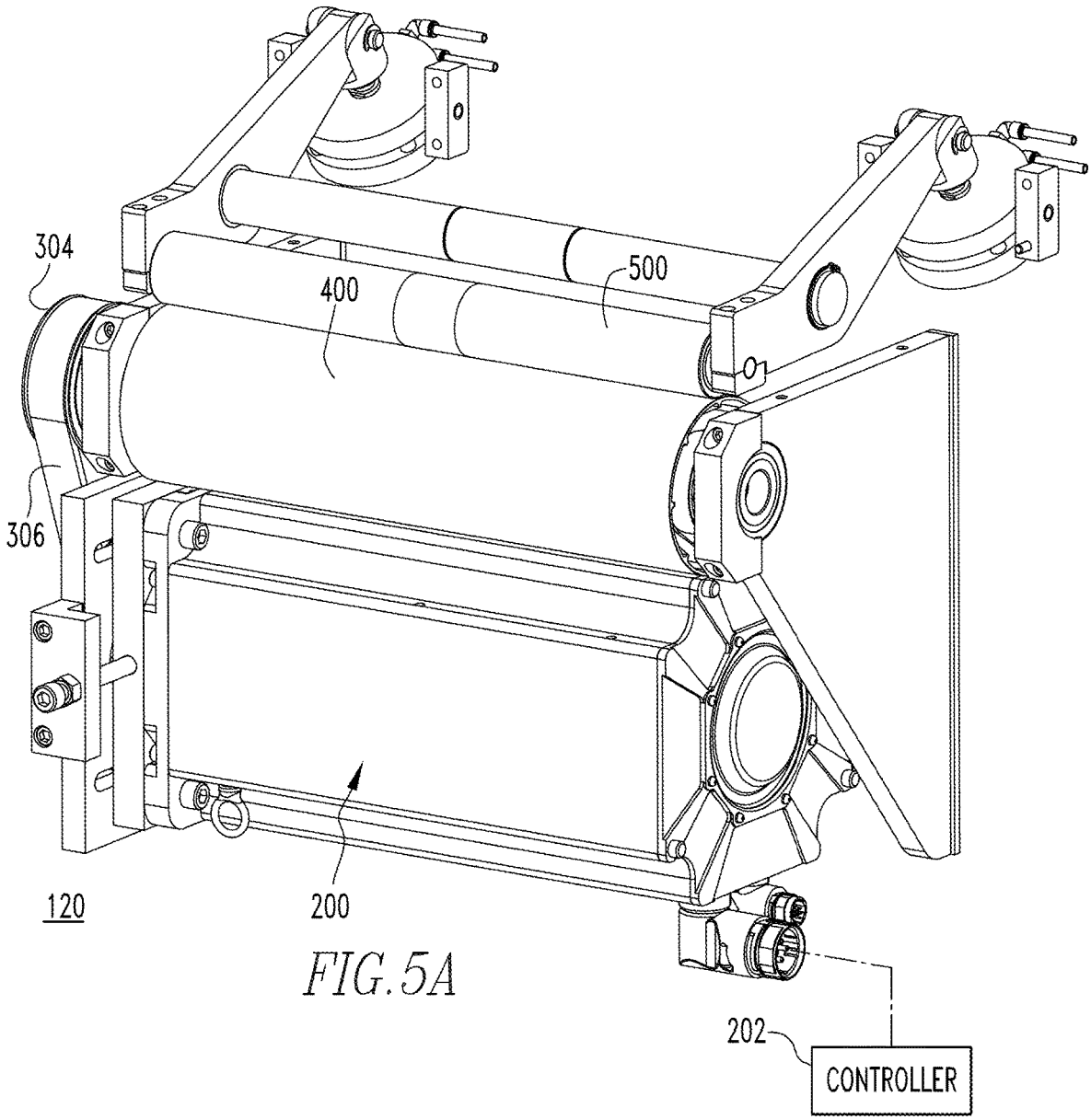
FIG. 5A is an isometric view of a portion of the feeding assembly.
Figure 5B:
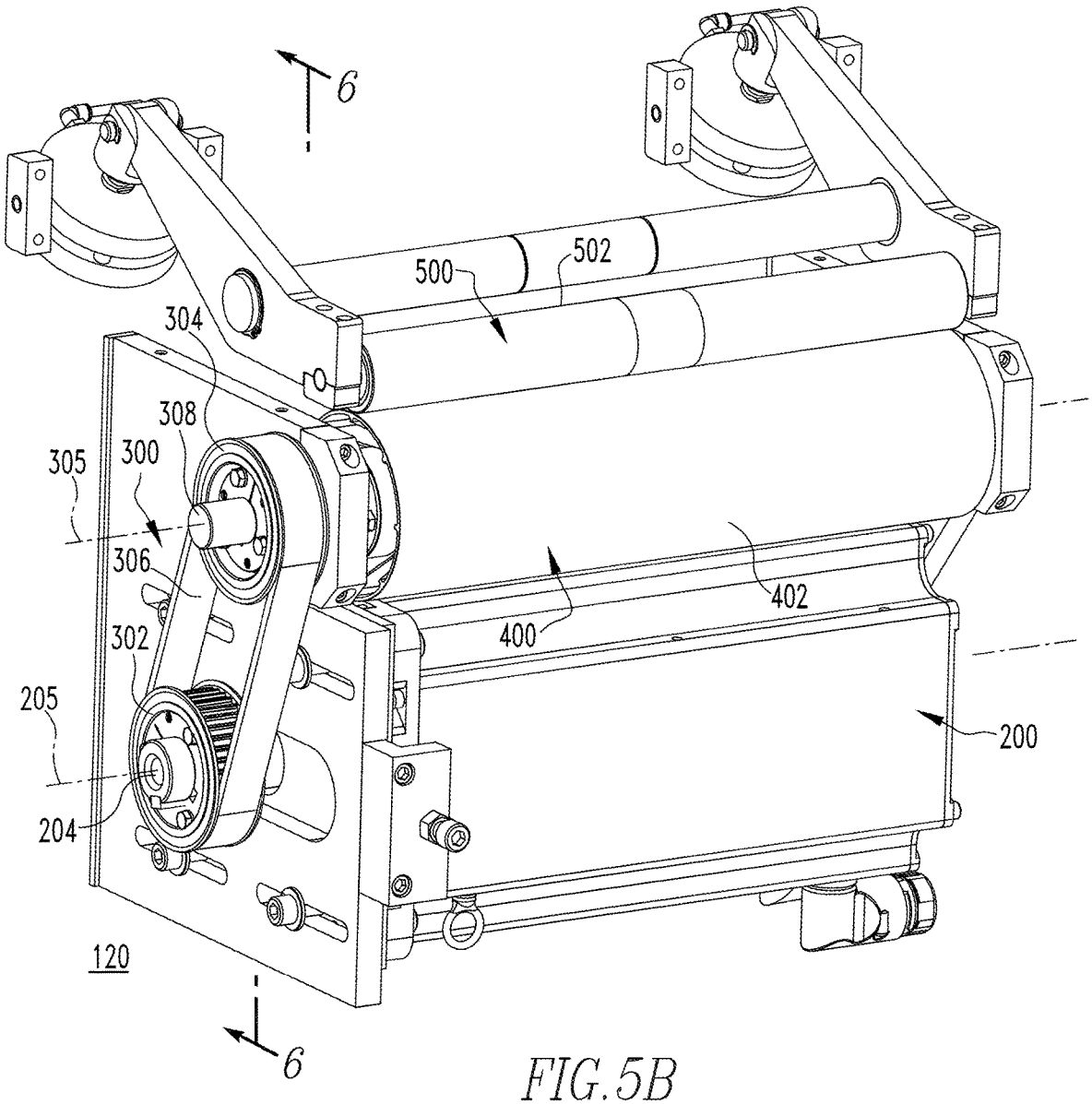
FIG. 5B is another isometric view of the feeding assembly of FIG. 5A.
Figure 6:
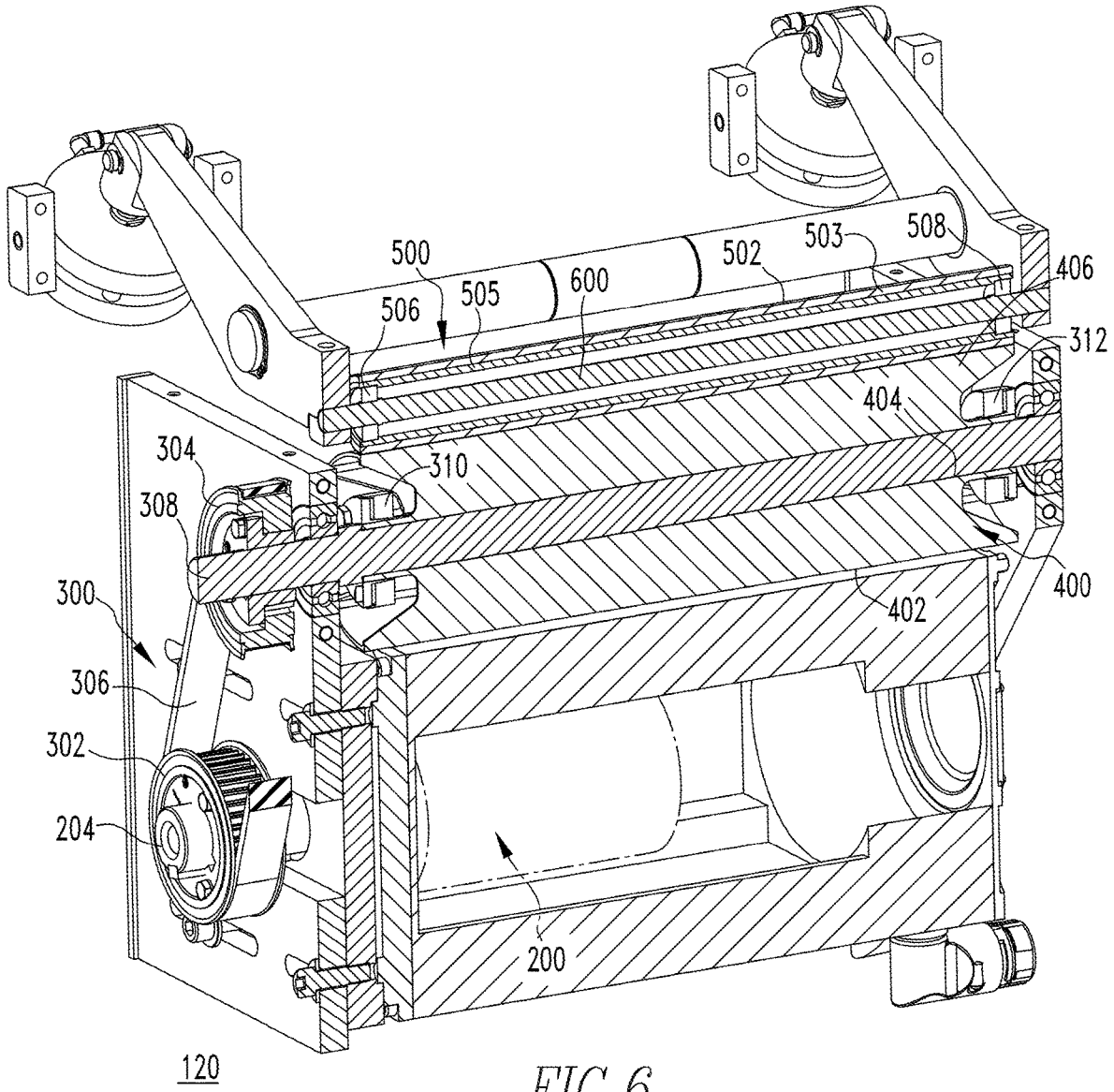
FIG. 6 is a section view taken along line 6-6 of FIG. 5B.

As shown in FIGS. 2-4, the feeding assembly 120 preferably includes a support element 121 (e.g., without limitation, a mounting base). FIGS. 5A, 5B and 6 show an enlarged view of a portion of the feeding assembly 120, without the support element 121. As best shown in FIG. 5B, a drive assembly 300 drives a feed roll 400 of the feeding assembly 120 and a pinch roll 500 cooperates with the feed roll 400 to receive and move the aforementioned material 150 (FIGS. 2 and 3) therebetween.

Continuing to refer to FIG. 5B, as well as the section view of FIG. 6, it will be appreciated that the example drive assembly 300 preferably includes a motor 200, such as a servo motor (partially shown in simplified form in phantom line drawing in FIG. 6), which includes a drive shaft 202 and a controller 250 (shown in schematically in FIG. 5A is capable of driving the inertia of the feed roll 400 and the pinch roll 500 at the desired speeds of approximately 450-700 spm. As will be described in greater detail hereinbelow with respect to FIGS. 7A, 7B, 8A and 8B the disclosed concept also incorporates a very lightweight design for the feed roll 400 and pinch roll 500.

The servo motor 200 is mounted below the feed roll 400, as shown in FIGS. 5A, 5B and 6 resulting in an offset of shaft centerlines (i.e., longitudinal axis). That is, as best shown in FIG. 5B, the longitudinal axis 205 of the motor drive shaft 204 is laterally offset with respect to the centerline 305 of the integral feed roll shaft 308. To resist backlash, the exemplary drive assembly 300 utilizes a pulley assembly 302, 304 and drive belt 308. More specifically, the pulley assembly includes a drive member 302 coupled to the motor drive shaft 204 and a pulley 304 coupled to the integral feed roll shaft 308. The drive belt 306 operatively couples the drive member 302 and the pulley 304.

Referring again to FIG. 2 and comparing the new feeding assembly 120 and press system 102 to the prior art feeding assembly 20 and press system 2 of FIG. 1, it will be appreciated that the feed roll 400 and pinch roll 500 are disposed substantially closer to the shell press 104 and, in particular, to the die set 110 than the prior art design. More specifically, the die set 110 of the shell press 104 has a centerline 114, and the feeding assembly 120 has a centerline 128. The distance, D, between the centerline 114 of the die set 110, 112 and the centerline 128 of the shell press 104 corresponds to the indexing stock. The new and unique design of the disclosed concept allows the amount of the indexing stock to be reduced by 50 percent, or more. Accordingly, 50 percent less weight of the material 150 (FIGS. 2 and 3) of the aluminum coil 152 (FIGS. 2 and 3) are required to be accelerated and decelerated every stroke of the shell press 104. In one non-limiting preferred embodiment of the disclosed concept, the indexing stock is 70 inches, or less. As another non-limiting preferred aspect of the disclosed concept, the longitudinal axis 305 of the integral feed roll shaft 308 is preferably disposed 40 inches, or less, from the centerline 114 of the die set 110.

This design also allows the stock loop 126 to be substantially reduced. The stock between the feed loop 126 and the die set 110, 112 moves intermittently, and the material stock 152 (FIGS. 2 and 3) being fed into the feed loop 126 of the feeding assembly 120 moves continuously. The disclosed concept advantageously minimizes the linear length of the intermittently moving stock.

The close proximity and reduced footprint and spacing of the disclosed press system 102 and feeding assembly 120 will be further appreciated with reference to FIGS. 2 and 3. That is, the press 104 includes a base 105, which in the example shown comprises legs 107, 109. In accordance with one non-limiting example embodiment, the support element 121 (e.g., without limitation, mounting base) of the feeding assembly 120 overlaps at least a portion (e.g., without limitation, leg 109) of the press base 105, as shown.

A still further unique aspect of the disclosed concept is best shown in FIG. 4. Specifically, the close proximity of components and aforementioned unique structure and configuration of the feeding assembly 120 limits available space for conveyance equipment, in particular, on the load side of the shell press 104. To resolve this issue, the load conveyance equipment 140 is disposed at an angle, as shown (see also FIG. 3). In more detail, the die set 110 is disposed in a horizontal plane, and the load conveyance equipment 140 is disposed at an angle 141 with respect to such horizontal plane. In one non-limiting example embodiment this angle 141 may be up to 20 degrees, or more.

Figure 7A:
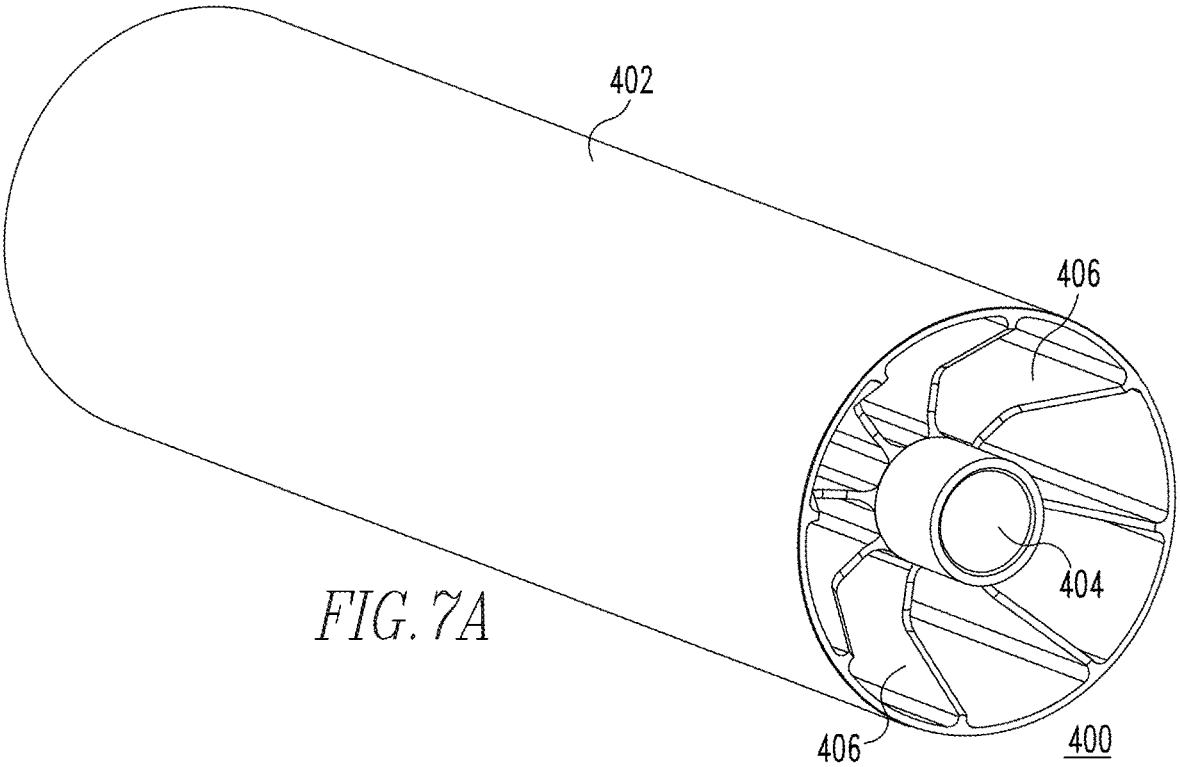
FIG. 7A is an isometric view of a feed roll for the feeding assembly, in accordance with another aspect of the disclosed concept.
Figure 7B:
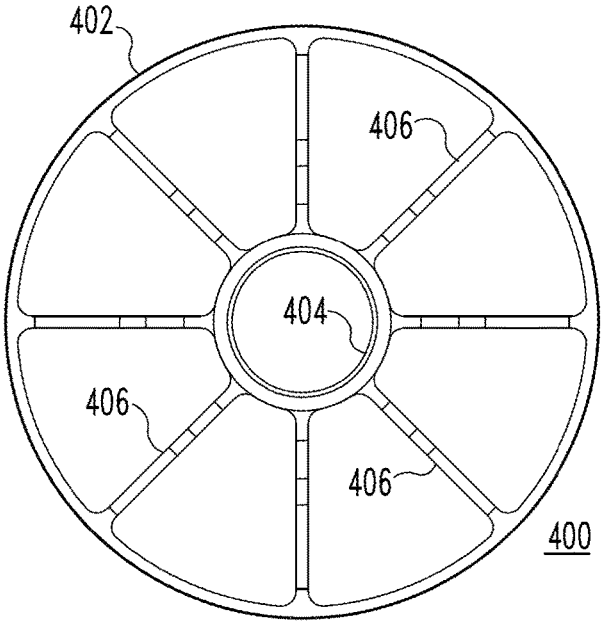
FIG. 7B is an end elevation view of the feed roll of FIG. 7A.

As previously noted, the feeding assembly 120 also utilizes new and unique lightweight feed roll 400 and pinch roll 500 designs. The feed roll is best shown in the section view of FIG. 6 and the enlarged views of FIGS. 7A and 7B. The example feed roll 400 includes an outer cylinder 402 and a concentric inner cylinder 404. The inner cylinder 404 is connected to the outer cylinder 402 by a plurality of webs 406 extending therebetween. In the non-limiting example shown and described herein, the feed roll 400 has eight (8) webs 406 extending between the outer cylinder 402 and the inner cylinder 404, as shown in FIGS. 7A and 7B. This structure results in a substantially hollow and thus lightweight structure, which among other advantages requires less inertia and momentum to move at relatively high speeds (e.g., without limitation, 450-700 spm). As shown in the section view of FIG. 6, the integral shaft 308, which extends through the inner cylinder 404 of the feed roll 400 is preferably made from a high-strength steel.

Figure 8A:
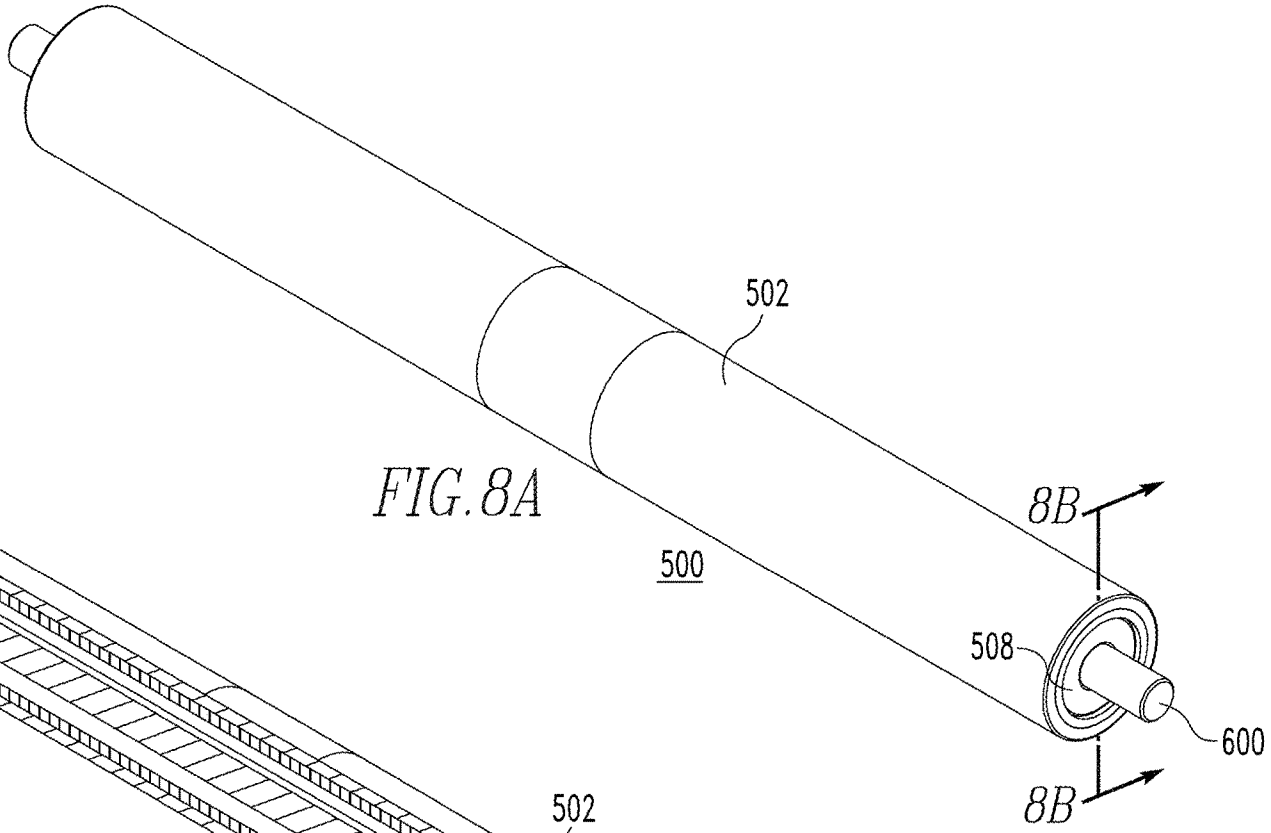
FIG. 8A is an isometric view of a pinch roll for the feeding assembly, in accordance with another aspect of the disclosed concept.
Figure 8B:
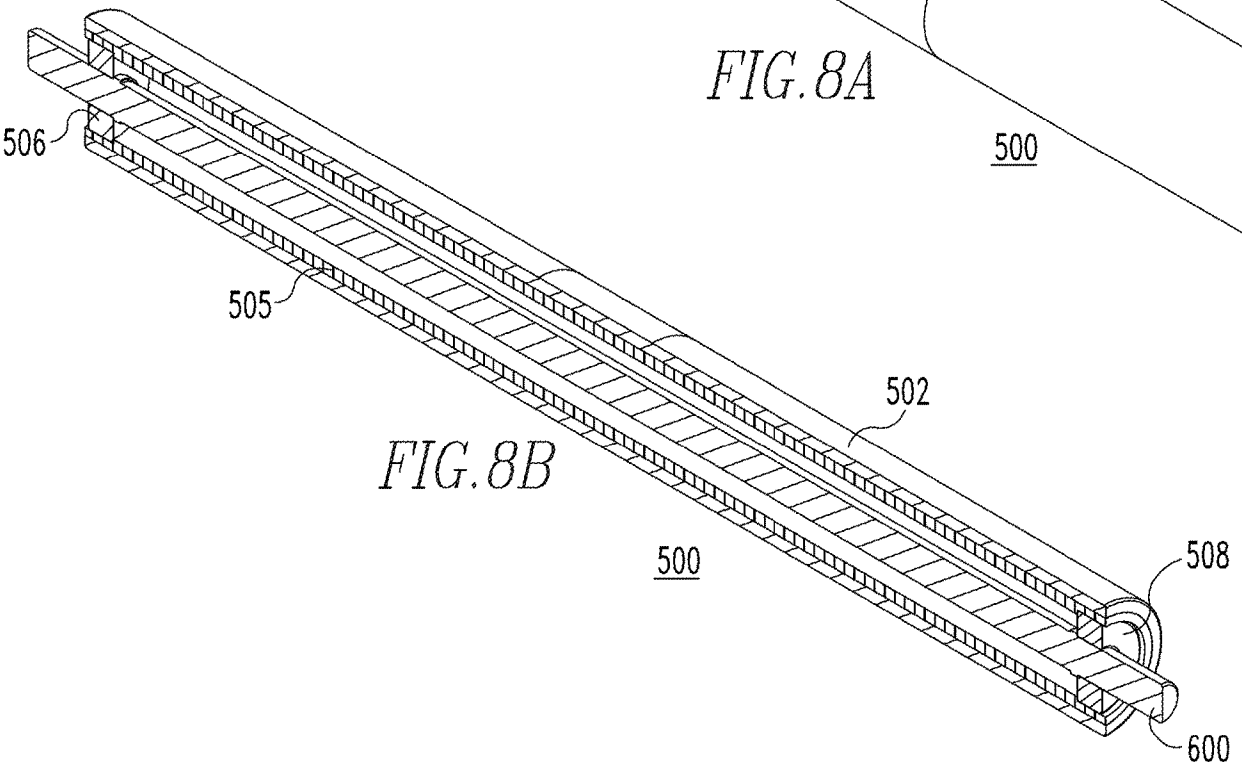
FIG. 8B is a section view taken along line 8B-8B of FIG. 8A.

The pinch roll 500 is best shown in FIG. 8A, and the section views of FIGS. 6 and 8B. In the non-limiting example shown, the pinch roll 500 has a relatively small diameter (e.g., without limitation, less than 5 inches) to reduce inertia, and comprises a composite construction. More specifically, as best shown in the enlarged section view of FIG. 8B, the pinch roll 500 preferably includes a core 505 and an outer cover 502 overlaying the core 505. In one embodiment, the core is preferably made from solid steel and the outer cover 502 is preferably made from polyurethane, which among other benefits, has no memory set. In the example shown, the pinch roll 500 assembly further includes a pair of bearings 506, 508 disposed at opposite ends within the core 505. A shaft 600 extends through the core 505 between the bearings 506, 508.

Accordingly, among other benefits, the disclosed feeding assembly 120 provides a number of unique features that enable the high-speed (e.g., without limitation, 450-700 spm) feeding of wide (e.g., without limitation, up to 50 inches, or wider) coil aluminum stock 152 to a press system 102 for improved manufacturing production of shells 106.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of disclosed concept which is to be given the full breadth of the claims appended and any and all equivalents thereof.

What is claimed is:

1. A feeding assembly for feeding material to a press system, the press system including a can shell press having a die set structured to form said material into a plurality of beverage or food can shells, the feeding assembly comprising:

a support element;

a feed roll coupled to the support element and including an integral shaft having a longitudinal axis, the feed roll configured to feed the press system material of aluminum coil stock having a width of 50 inches or wider;

a drive assembly structured to drive the feed roll, the drive assembly including a motor and a drive shaft, the drive shaft having a longitudinal axis; and a pinch roll structured to cooperate with the feed roll to receive and move said material therebetween, wherein the longitudinal axis of the integral feed roll shaft is laterally offset with respect to the longitudinal axis of the motor drive shaft, wherein the feeding assembly feeds the material of aluminum coil stock to the press system to make the plurality of beverage or food can shells at 450 strokes per minute (spm) or greater, wherein:

the die set is disposed in a horizontal plane, the shell press has load conveyance equipment disposed at an angle outside of the horizontal plane of the die set, at least a portion of the load conveyance equipment is arranged above the feed roll and the pinch roll, and the load conveyance equipment is disposed at the angle such that one end of the load conveyance equipment is arranged vertically above the horizontal plane.

2. The feeding assembly of claim 1 wherein:

the feeding assembly feeds the press system the material via an index and dwell feeding cycle;

the die set of the shell press has a centerline; wherein the feeding assembly has a centerline; wherein the distance, D, between the centerline of the die set and the centerline of the feeding assembly is a length of the indexing stock; and the length of the indexing stock is 70 inches or less.

3. The feeding assembly of claim 2 wherein the longitudinal axis of the integral feed roll shaft is disposed 40 inches or less from the centerline of the die set.

4. The feeding assembly of claim 1 wherein:

the support element is a mounting base arranged vertically below the feed roll, the shell press has a base comprising a pair of legs arranged on opposing sides of the base; and the support element of said feeding assembly is arranged to overlap at least a portion of one of the pair of legs.

5. The feeding assembly of claim 1 wherein the feed roll comprises an outer cylinder, a concentric inner cylinder, and a plurality of webs extending longitudinally through the feed roll between and connecting the outer cylinder and the inner cylinder to create a lightweight substantially hollow structure.

6. The feeding assembly of claim 1 wherein the feeding assembly feeds the material of aluminum coil stock to the press system at a speed of 450 spm to 700 spm.

7. The feeding assembly of claim 1 wherein the feed roll and the pinch roll overlap at least a portion of a base of the shell press.

8. The feeding assembly of claim 1 wherein:

the shell press includes a base configured to support the shell press on a horizontal surface; and the feed roll and the pinch roll overlap at least a portion of the base of the shell press in a vertical plane.

9. A press system comprising:

a shell press including a base and a die set;

a feeding assembly for feeding material to the shell press and between the die set to form a plurality of shells, the feeding assembly comprising:

a support element, a feed roll coupled to the support element and including an integral shaft having a longitudinal axis, a drive assembly structured to drive the feed roll, the drive assembly including a motor and a drive shaft, the drive shaft having a longitudinal axis, and a pinch roll cooperating with the feed roll to receive and move said material therebetween, wherein the feed roll and the pinch roll overlap at least a portion of a base of the shell press; and conveyance equipment for conveying the shells, wherein:

the die set is disposed in a horizontal plane, the shell press has load conveyance equipment and exit conveyance equipment, the load conveyance equipment is disposed at an angle outside of the horizontal plane of the die set, at least a portion of the load conveyance equipment is arranged above the feed roll and the pinch roll, and the load conveyance equipment is disposed at the angle such that one end of the load conveyance equipment is arranged vertically above the horizontal plane.

10. The press system of claim 9 wherein:

the feeding assembly feeds the press system the material via an index and dwell feeding cycle;

the die set of the shell press has a centerline; wherein the feeding assembly has a centerline; wherein the distance, D, between the centerline of the die set and the centerline of the feeding assembly is a length of the indexing stock; and the length of the indexing stock is 70 inches or less.

11. The press system of claim 10 wherein the longitudinal axis of the integral feed roll shaft is disposed 40 inches or less from the centerline of the die set.

12. The press system of claim 9 wherein:

the support element is a mounting base arranged vertically below the feed roll, the shell press has a base comprising a pair of legs arranged on opposing sides of the base; and the support element of said feeding assembly is arranged to overlap at least a portion of one of the pair of legs.

13. The press system of claim 9 wherein the feed roll comprises an outer cylinder, a concentric inner cylinder, and a plurality of webs extending longitudinally through the feed roll between and connecting the outer cylinder and the inner cylinder to create a lightweight substantially hollow structure.

14. The press assembly of claim 9 wherein the angle is at least 20 degrees.

15. The press system of claim 9 wherein the feeding assembly is configured to feed the press system material of aluminum coil stock having a width of 50 inches or wider.

16. The press system of claim 9 wherein the feeding assembly feeds the material of aluminum coil stock to the press system at a speed of 450 spm to 700 spm.

* * * * *